United States Patent [19]

Sowter et al.

[11] 4,214,221

[45] Jul. 22, 1980

[54] CONVERGENCE ASSEMBLY FOR CATHODE RAY TUBE

[75] Inventors: Brian R. Sowter; William A. Warwick, both of Winchester, England

[73] Assignee: International Business Machines Corporation, Armonk, N.Y.

[21] Appl. No.: 966,440

[22] Filed: Dec. 4, 1978

[30] Foreign Application Priority Data

Dec. 9, 1977 [GB] United Kingdom ..... 51439/77

[51] Int. Cl.[2] ..... H01F 7/06; H01J 29/66

[52] U.S. Cl. ..... 335/212; 335/210

[58] Field of Search ..... 335/210, 212, 213, 214

[56] References Cited

U.S. PATENT DOCUMENTS

| | | | |
|---|---|---|---|
| 2,568,456 | 9/1951 | Malheiros | 335/212 |
| 2,880,339 | 3/1959 | Kroger | 335/212 |
| 3,002,120 | 9/1961 | Clay | 335/212 |
| 3,424,942 | 1/1969 | Barbin | 315/27 |
| 3,831,122 | 8/1974 | Hanke et al. | 335/210 |

FOREIGN PATENT DOCUMENTS 1428678 3/1976 United Kingdom .

*Primary Examiner*—Harold Broome
*Attorney, Agent, or Firm*—Frederick D. Poag

[57] ABSTRACT

An electromagnetic lateral convergence assembly includes a generally-annular, planar magnetic core (optionally found as a laminate) having integral pole pieces extending toward the center of the annulus. Electrical coils are mounted on selected pole pieces for producing a convergence-compensating magnetic field within the center of the annulus. The coils are secured to a printed circuit board to hold the core in spaced parallel relationship to the board. Optionally a purity assembly including a planar magnetic core having a number of electrical coils for producing a rotatable, variable, linear field is mounted on the other side of the printed circuit board.

10 Claims, 16 Drawing Figures

CONVERGENCE ASSEMBLY FOR CATHODE RAY TUBE

BACKGROUND OF THE INVENTION

1. Field of the Invention

This invention relates to an electromagnetic deflection assembly for a cathode ray tube.

2. Description of the Prior Art

In a color cathode ray tube, three separate electron beams (blue, green and red) are caused to scan across the faceplate of the cathode ray tube. Each beam is arranged so that is illuminates only phosphor dots corresponding to its color. Thus the blue beam should only strike blue phosphor dots, the green beam should only strike green phosphor dots, and the red beam should only strike red phosphor dots. To this end, color cathode ray tubes, in addition to the scanning yokes which will be found on cathode ray tubes, are provided with controls to adjust the positions of the three beams relative to one another. Commonly, controls are provided which correct for convergence of the three beams and for the purity of the resulting colors.

British Pat. No. 1,428,678 discloses a so-called lateral-blue convergence assembly in which a strip of high permeability magnetic material is bent to form six pole pieces intended to be spaced around the neck of the cathode ray tube. Coils are provided around three of the pole pieces and by suitable positioning the pole pieces and selecting appropriate currents, the blue beam can be shifted laterally of itself.

Purity rings consisting of a pair of magnetized annular magnets have been used in the past for adjusting the purity. The two magnets are rotatable about the neck of the cathode ray tube and relative to one another so as to produce a magnetic field within the neck whose magnitude and direction can be varied by rotation of the magnets. More recently, the use of electromagnetic coils instead of permanent magnets has been suggested for purity adjustment.

Until now, most color cathode ray tubes have been produced for domestic television sets which typically may have 625 scan lines on the screen. Such cathode ray tubes are not very suitable for displaying text or graphic images because of their limited resolution. The cathode ray tube industry is now beginning to produce high resolution color monitors which are designed to display text and graphical data to a much higher resolution than normal domestic television sets. Such high resolution monitors are characterized by a larger number of phosphor dots, a larger number of holes in the shadow mask tube, and much more stringent requirements as to the accuracy of the scanning coils etc. Pin cushion distortion and other similar defects are much more visible when displaying text and graphical data than when displaying moving or still pictures. It is important that these stiffer requirements do not impose too high a cost penalty.

SUMMARY OF THE INVENTION

An object of the present invention is to provide an electromagnetic deflection assembly which can be used in a high resolution color cathode ray tube.

According to the present invention, an electromagnetic lateral convergence assembly for use in a color cathode ray tube apparatus comprises an electrically-insulating planar support adapted to be mounted on the neck of a cathode ray tube in a plane orthogonal to the neck, a first planar magnetic core of high permeability magnetic material having a generally central aperture and having integral pole pieces extending toward the center of the aperture, at least three electrical coil assemblies mounted on selected pole pieces for producing, when energized, a magnetic field within the aperture, and means securing the magnetic coil assemblies to said insulating support to hold said magnetic core in spaced parallel relationship with said support.

BRIEF DESCRIPTION OF THE DRAWINGS

The invention will now be particularly described, by way of example, with reference to the accompanying drawings, in which.

DETAILED DESCRIPTION OF THE DRAWINGS

Figure 1:
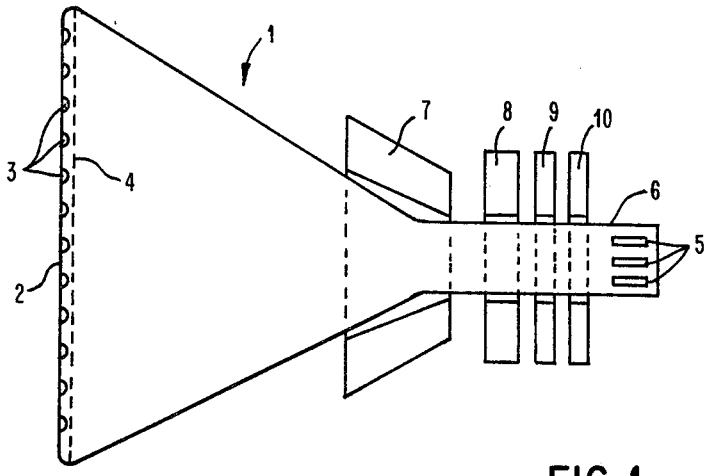
FIG. 1 is a simplified schematic of a color cathode ray tube.

Referring now to FIG. 1, a color cathode ray tube 1 comprises a face plate 2 on which are formed a plurality of blue, green and red phosphor dots 3. Located adjacent the face plate 2 is an apertured shadow mask 4 by means of which selected phosphor dots 3 can be stimulated by an electron beam from one of the three electron guns 5 located in the neck 6 of the cathode ray tube. A scanning coil unit 7 enables the electron beams from the guns 5 to be scanned across the shadow mask 4. A radial convergence unit 8, a purity unit 9 and a lateral convergence unit 10 are located around the neck 6 to allow for adjustment of the purity and convergence of the three electron beams. It will be appreciated that the relative positions of the units 8 to 10 can be changed so that, for example, the lateral convergence unit 10 could be interposed between the radial convergence and purity units.

Figure 2:
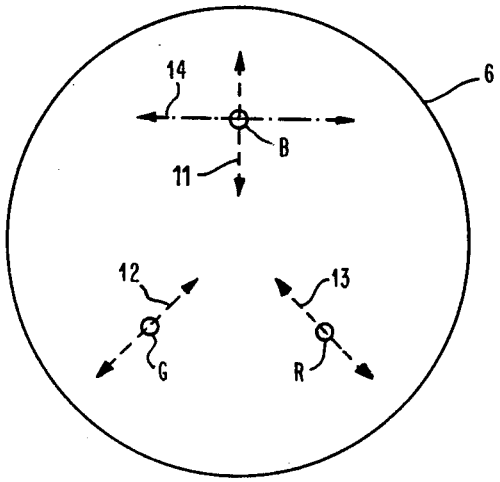
FIG. 2 is a diagram showing adjustments necessary to correct for convergence.

FIG. 2 is a sectional view of the neck 6 showing the relative positions of the blue, green and red electron beams B, G and R respectively. The purpose of the radial convergence unit 8 (FIG. 1) is to allow the positions of the beams B, G and R to be shifted relative to one another in a radial direction, that is the directions 11, 12 and 13 respectively. To ensure that the three beams can be made to converge on one aperture of the shadowmask, it is necessary to be able to shift at least one of the beams laterally with respect to the others.

The lateral convergence unit 10 (FIG. 1) is arranged to shift the blue beam B in the direction 14. It will be appreciated however that either the green or the red beam could be shifted laterally instead of or as well as the blue beam.

Figure 3A:
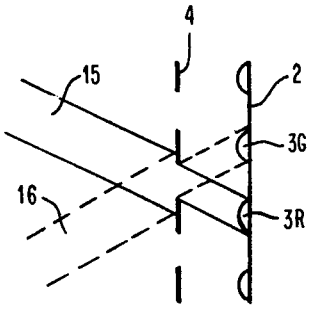
FIGS. 3A and 3B are diagrams illustrating the problem of obtaining purity.
Figure 3B:
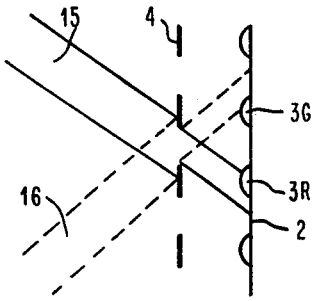

FIG. 3A illustrates how a red beam 15 and a green beam 16 impinge on the face plate 2 to stimulate a red phosphor dot 3R and a green phosphor dot 3G respectively. With the beams incident on the shadow mask 4 at the angles shown, the whole of the phosphor dots 3G and 3R will be stimulated. FIG. 3B shows the effect when the beams 15 and 16 are incident at an incorrect angle. It will be seen that not all of the respective phosphor dot is stimulated so at best, the display will not be as bright as it should be. At worst, a red beam impinging at an incorrect angle could stimulate an adjacent blue or green phosphor dot instead of the red dot. The purity unit 9 (FIG. 1) allows the correct angle of incidence to be adjusted: the angle will depend upon the position within the yoke 7 (FIG. 1) from which the beam is deflected and this position can be adjusted, as explained above, by means of a rotatable magnetic field whose magnitude can also be adjusted.

Figure 4:
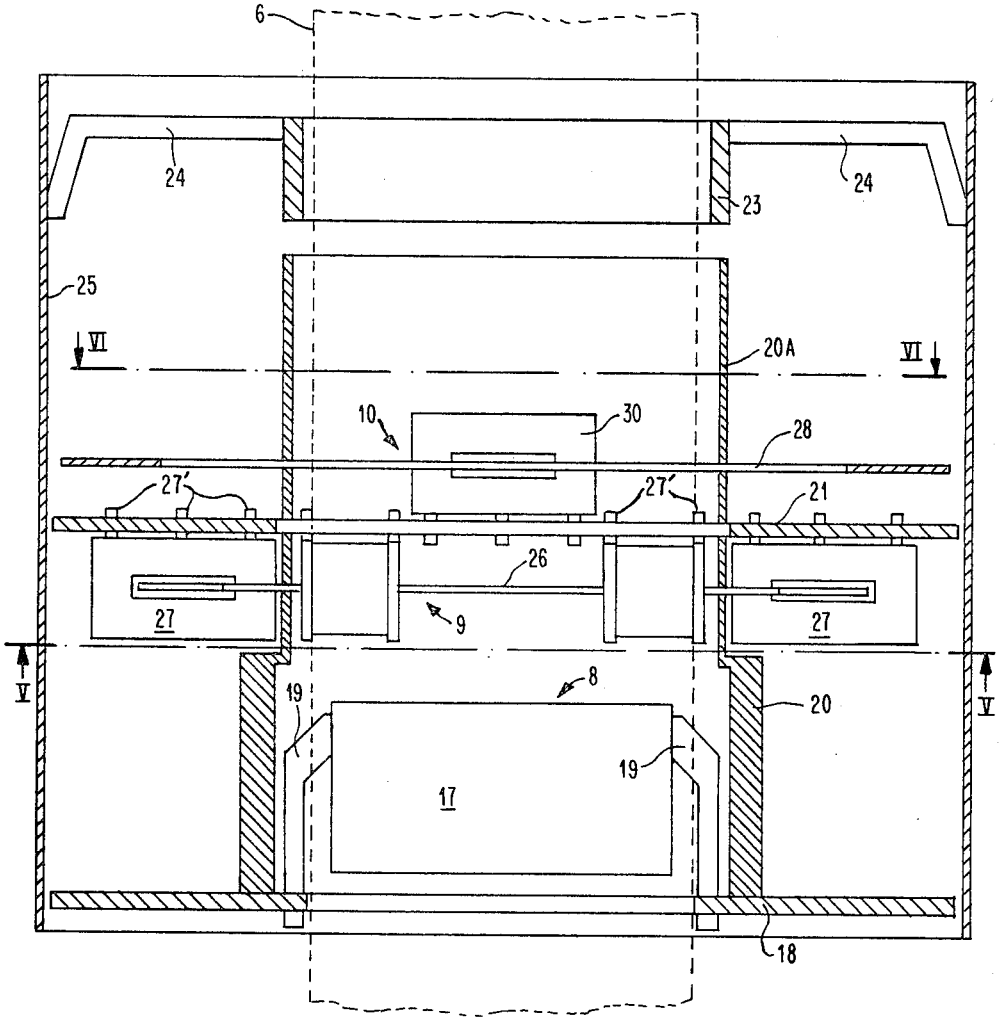
FIG. 4 shows a preferred embodiment of the invention and consisting of a lateral convergence unit and a purity unit.

FIG. 4 is a sectional view of a preferred embodiment of the invention and shows an electromagnetic assembly comprising radial convergence unit 8, purity unit 9 and lateral convergence unit 10. The radial convergence unit 8 does not form part of the present invention and therefore will not be described in detail. Briefly however, unit 8 comprises three electromagnetic coil units 17 (only one of which is shown), one for each beam, mounted on a printed circuit card 18 which is slidably mounted on the neck 6 of the cathode ray tube (shown in phantom). Each unit 17 is fixed to the printed circuit card by flexible strip-like terminals 19 which allow currents to be supplied to the coil units to control radial convergence of the beam associated with that coil unit.

Secured to the printed circuit card 18 is a sleeve 20 which has a small gap between it and the CRT neck 6. Three longitudinally extending slots are formed in an upper portion 20A of the sleeve 20 (as will be seen in FIG. 5) which allow a printed circuit card 21 to be mounted thereon by means of three lugs 22 (see FIGS. 5 6, and 7) which contact the CRT neck 6 and serve to center the printed circuit card 21 with respect to the neck 6. Although in the preferred embodiment the card 21 is of epoxy glass, it will be appreciated that any other appropriate electrically insulating material could be used. Indeed, the card 21 could be replaced by an insulating support which is not a printed circuit board, but which carries discrete wiring. The purity unit 9 and lateral convergence unit 10 are both supported on the card 21.

Also shown in FIG. 4 is a collar 23 which is slidably supported on the CRT neck 6 and which carries arms 24 supporting a cylindrical magnetic shield 25. The shield 25 is supported at its lower end by the printed circuit card 18. The sleeve 20 and collar 23 may be formed from any suitable plastic material such as nylon or polycarbonate. The shield 25 may be formed from high permeability magnetic materials such as a nickel-iron alloy, for example MUMETAL or PERMALLOY (Registered Trademarks), a silicon iron, for example LOSIL 1000 or STALLOY (Registered Trademarks).

Figure 5:
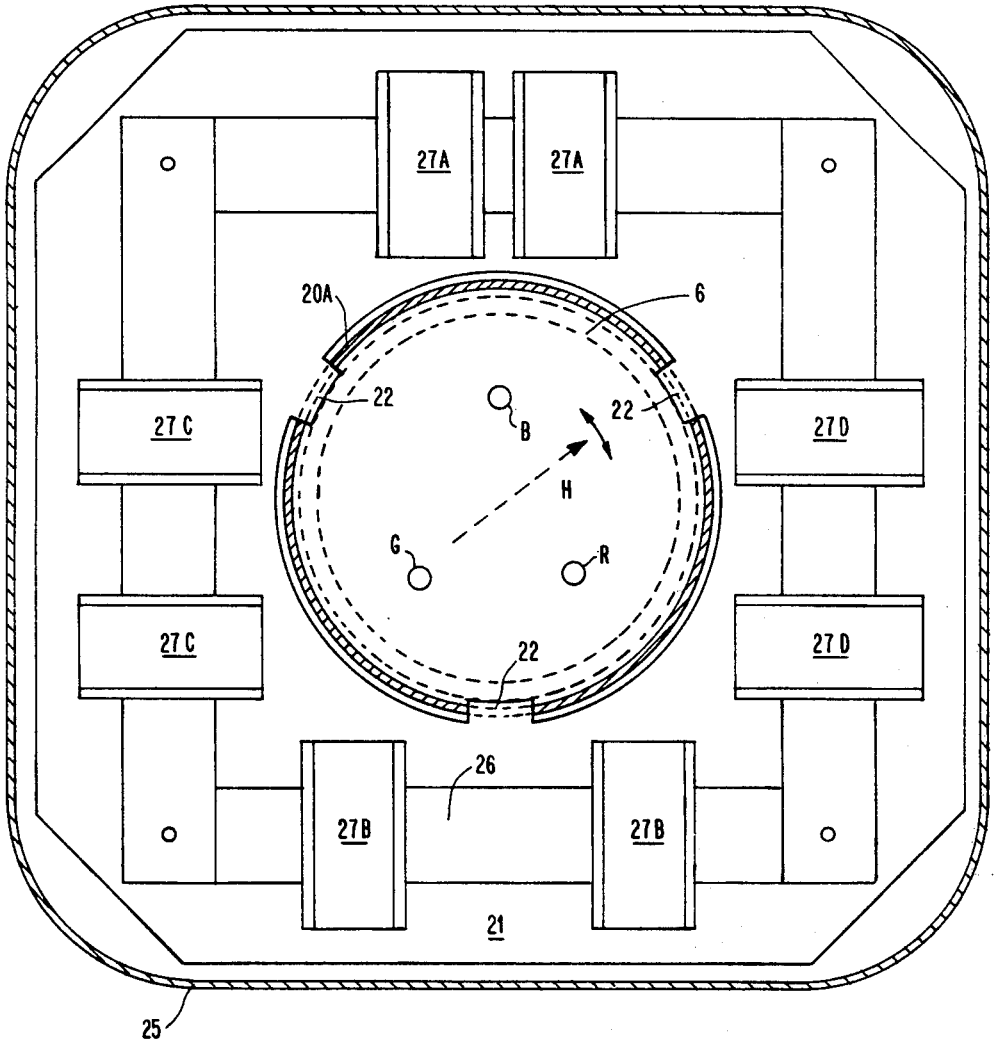
FIG. 5 shows the purity unit of FIG. 4 in more detail.

FIG. 5 which is a view along the line V—V, FIG. 4, shows the electromagnetic purity unit 9 in more detail. A magnetic core 26 is surrounded by a number of electromagnetic coils 27 which are mounted on the printed circuit card 21 by means of lugs 27'. Coils 27A and 27B are connected together (see FIG. 7A) to produce a horizontal (as viewed in the drawing) magnetic field component. Coils 27C and 27D are connected together (see FIG. 7A) to produce a vertical (as viewed in the drawing) magnetic field component. By appropriately varying the currents supplied to the coils 27A and B and the coils 27C and D, the strength and direction of the resultant magnetic field H can be chosen to ensure the purity is adjusted correctly as described above with reference to FIGS. 3A and B.

Figure 10:
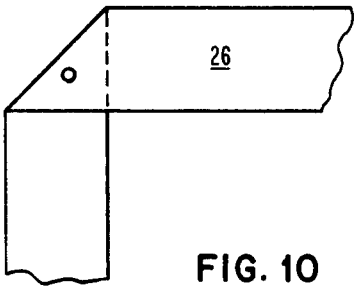
FIGS. 10 and 11 show alternative shapes for the magnetic core of the purity unit of FIG. 5.
Figure 11:
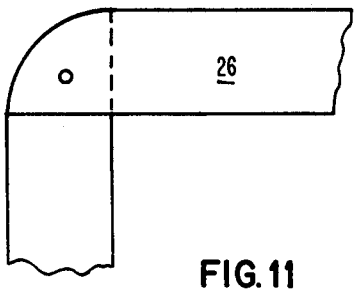

The magnetic core 26 is shown as formed from four strips of high permeability magnetic material, but may be formed in other ways. Suitable materials are those described above with respect to the magnetic shield 25. To avoid eddy currents etc., the core 26 may be formed from a laminate which can either be of one material or a combination of different materials, for example alternating strips of nickel-iron alloy and silicon iron. Those skilled in the art will appreciate that other shapes may be used for the strips constituting the magnetic core 26. Thus, for example, strips having the shapes shown in FIGS. 10 and 11 may be used to decrease stray magnetic fields. The core could also be formed from a different number of component parts. All that is required is that some provision should be made for threading the coils 27 over the core.

Figure 12:
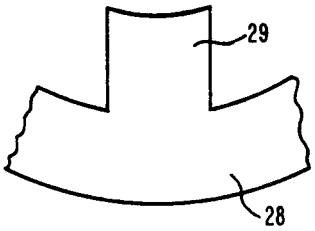
FIGS. 12 and 13 show alternative shapes for the pole pieces of the magnetic core of the lateral convergence unit of FIG. 6.
Figure 13:
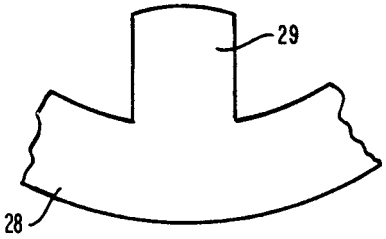

The lateral convergence unit 10 will now be described with reference to FIG. 4 and FIG. 6 which is a view in the direction VI—VI, FIG. 4. Unit 10 consists of a magnetic core 28 which is generally annular in shape with pole pieces 29 extending toward the CRT neck 6. The material of the core 28 can be the same as those specified above for the core 26. Three electromagnetic coils 30 are mounted as a push fit on three of the pole pieces 29 as shown and when energized produce a magnetic field pattern shown in chained line. The shape of the magnetic field pattern can be adjusted by shaping appropriate ones of the pole pieces 29 as shown, for example, in FIGS. 12 and 13, by varying the relative positions of the pole pieces 29 around the neck 6, or by providing additional electromagnetic coils on those pole pieces which are not shown in the drawing as having pole pieces. The magnetic field pattern ideally is shaped so that the three beams are located at areas where the magnetic field is oriented vertically, as viewed in the drawing. By varying the currents in the coils 30, the beams can be moved laterally in the directions of the arrows.

To enable both dynamic and static convergence correction without the need for complicated current drivers, each of the coils 30 has a double winding. Static convergence adjustment is performed with one winding and allows correction of misconvergence due to manufacturing and assembly tolerances and normally consists of passing a static current through the windings to correct the convergence at the center of the CRT face plate. Dynamic convergence adjustment is performed with the other winding and allows correction of misconvergence due to the position of the beam at the CRT face plate. Apparatus and methods for dynamic convergence correction are described in the Complete Specifications of United Kingdom application for Letters Patent No. 53583/76 (U.K. Pat. No. 1,517,119 issued Oct. 25, 1978) and United Kingdom application for Letters Patent No. 38584/77, and their counterpart U.S. patent applications Ser. Nos. 860,402 filed Dec. 13, 1977 and 940,695 filed Sept. 8, 1978. In those applications means are described to derive and apply varying signals to convergence coils in correspondence to the position of the electron beams relative to the CRT screen as required for proper convergence.

Figure 8:
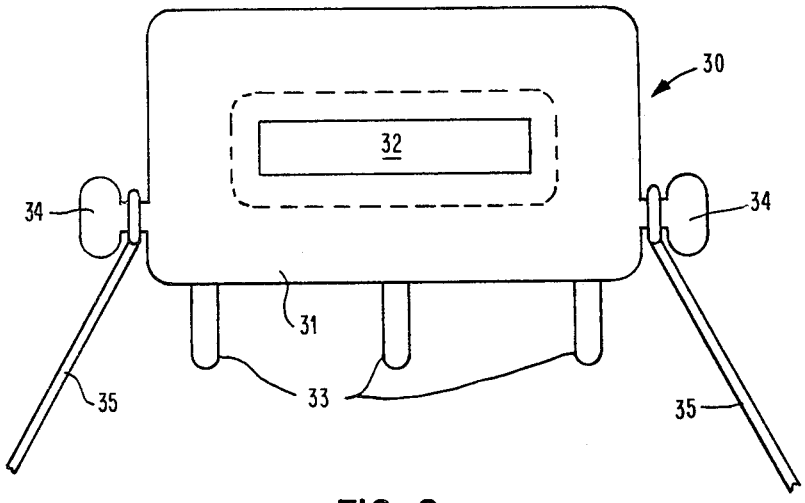
FIGS. 8 and 9 show typical electromagnetic coils.
Figure 9:
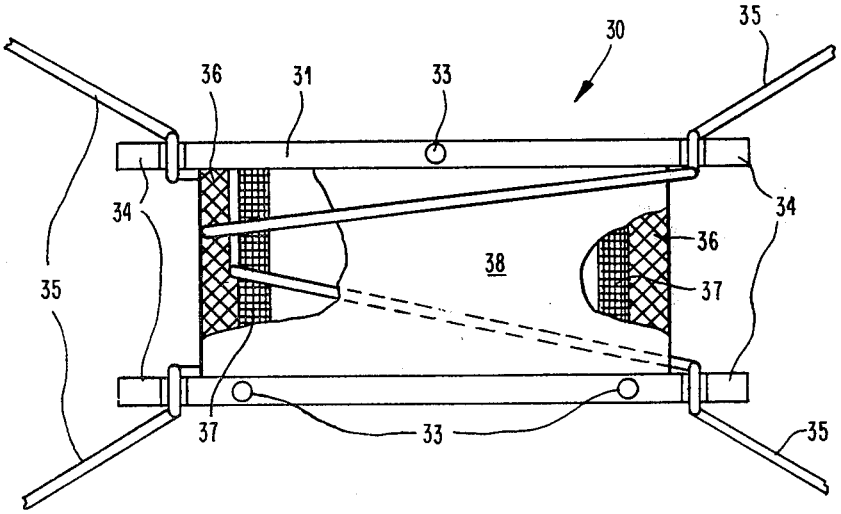

FIGS. 8 and 9 are views of a suitable double-wound coil which can be used in the lateral convergence unit 10. The coil consists of a plastic bobbin 31, for example of polycarbonate or nylon material, having a central aperture 32 which is of such a size as to allow the bobbin 31 to be a push fit on the pole pieces 29 of the magnetic core 28. Three dependent and integrally formed lugs 33 allow the bobbin 31 to be mounted in holes in the printed circuit card 21. Four integrally formed lugs 34 allow strain relief of the coil terminals 35 which are wrapped around recesses in the lugs 34. Two windings 36 and 37 are wound around the bobbin 31 as shown in FIG. 9 and are protected by a sheath 38 shown partly broken away to expose the underlying windings.

Although the double-winding coil assembly of FIGS. 8 and 9 has been described in connection with the lateral convergence assembly 10, it will be appreciated that it could also be used in the purity assembly 9 in which event the two windings may be connected together or one winding may be disconnected if only static purity adjustments are to be made. In a modification of the purity assembly, not shown or further described, both windings may be used with one employed for static purity adjustment and the other employed for dynamic purity adjustment. Of course, single-wound coils could be used with a variable current to provide for dynamic purity adjustment: this would allow the purity to be tailored for the different screen positions but would require fairly complex current drivers.

Figure 7A:
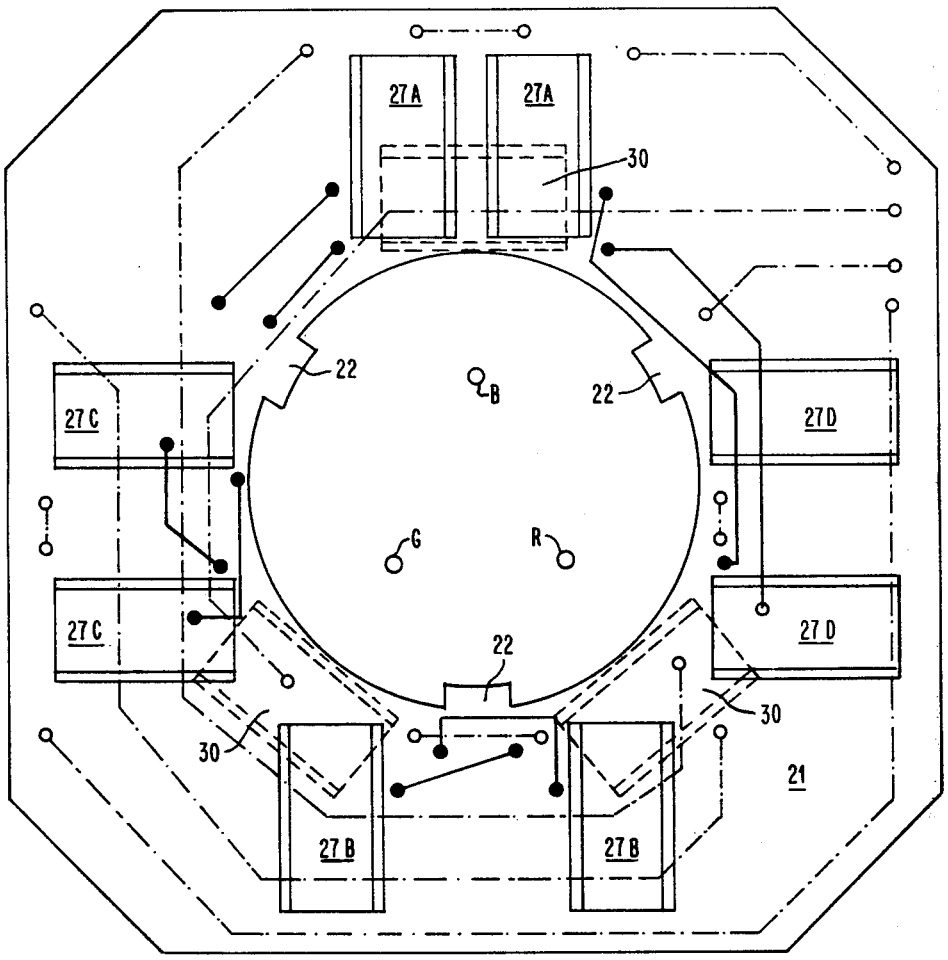
FIG. 7A illustrates how various electromagnetic coils shown in FIGS. 5 and 6 are connected together.

FIG. 7A is a wiring diagram showing how the various coils are connected together. In FIG. 7A, the solid lines represent the electrical connections for the coils 30 of the lateral convergence unit 10. The chained lines represent the electrical connections for the coils 27 of the purity unit 9. It will be noted that the wiring is shown as being on the opposite side of the card 21 to the relevant coils. However in practice it would be possible to have the wiring on the same side of the card as the associated coils.

Figure 7B:
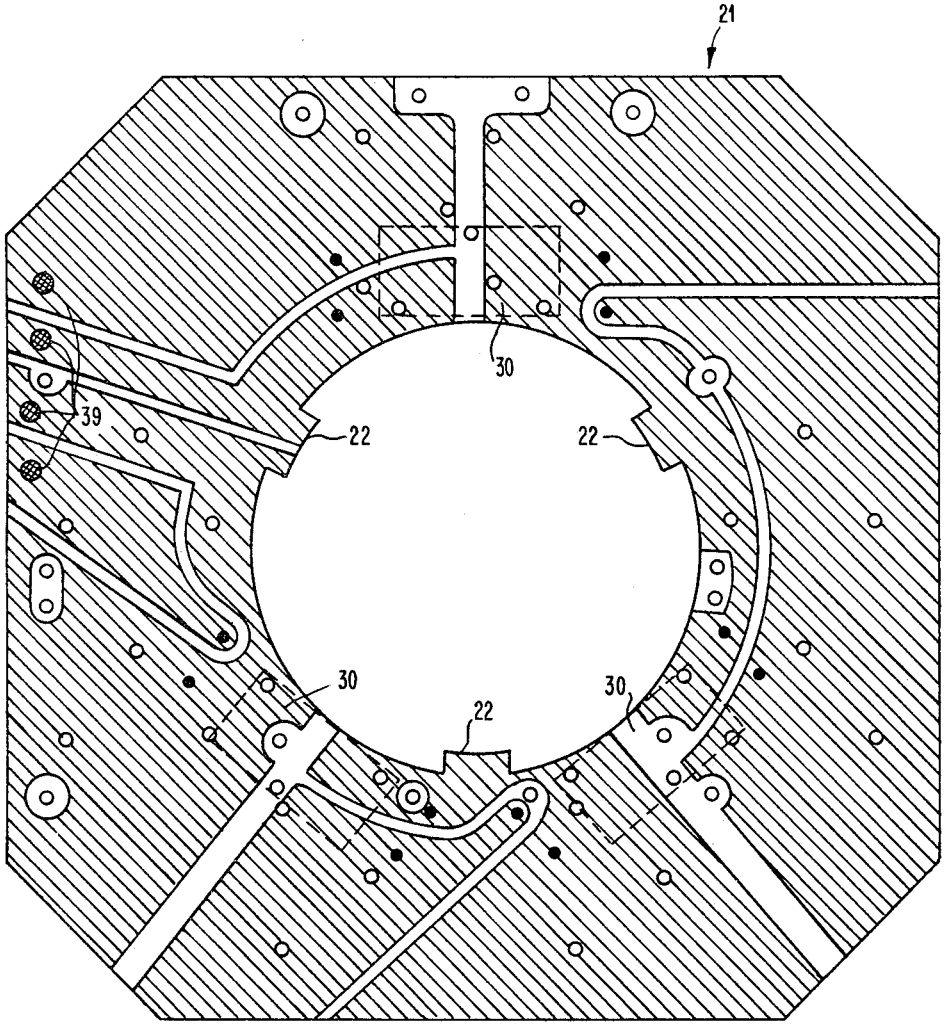
FIG. 7B illustrates printed wiring for the lateral convergence unit of FIG. 6.

FIG. 7B illustrates a possible layout of printed wiring for the lateral convergence coils. Solid dots represent holes through which the terminals of the convergence coils 30 (shown in phantom) protrude for solder connection to the appropriate conductive lands which may, for example, consist of copper. Connections to the card are made at terminals 39. The other holes shown in FIG. 7B allow mounting of the coils and protrusion of the terminals of the purity coils.

Figure 7C:
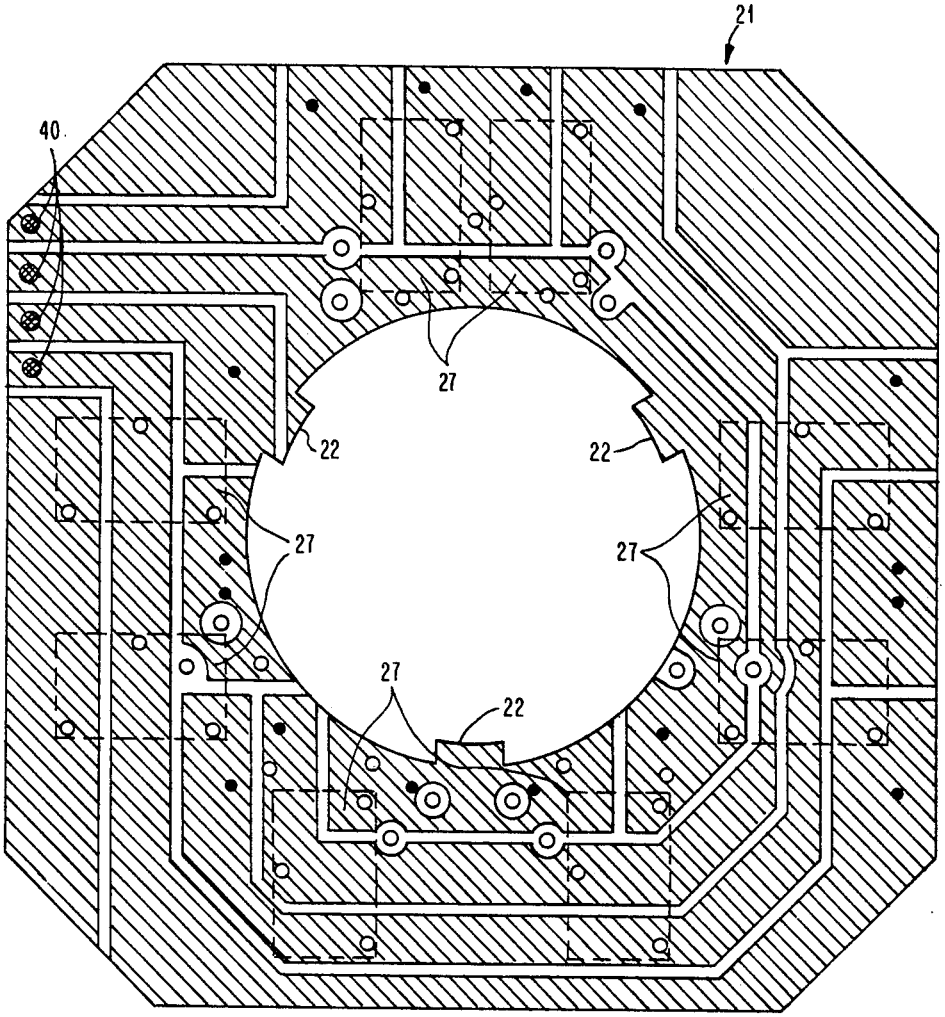
FIG. 7C illustrates printed wiring for the purity unit of FIG. 5.

FIG. 7C similarly illustrates a possible layout of printed wiring for the purity coils. Solid dots represent holes through which solder connections can be made for the purity coils 27 shown in phantom. Connections to the card are made at terminals 40. It will be appreciated that a somewhat more complex layout of the wiring would be required if double-wound purity coils were used to provide for static and dynamic purity adjustment, as mentioned above.

What has been described is an electromagnetic lateral convergence and purity assembly which has a number of advantages. Because the magnetic cores are planar in form they can be cheaply produced by stamping without the need for complicated or expensive assembly jigs. Their shape can be readily adapted for different CRT requirements. Because of the planar construction, the magnetic fields are essentially in the plane of the respective core: this should reduce magnetic interaction between the two units. Because no complicated bending of the magnetic core material is required, this allows sheets of different high permeability materials to be mixed to provide improved frequency response of the core. Thus the core could be made of a sheet of STALLOY (Registered Trademark) material sandwiched between two sheets of MUMETAL (Registered Trademark) material. In addition, because no permanent magnets are used, the magnetic fields can be varied electrically and therefore remotely from the electrodes carrying high voltages (normally 5 KV or 20 KV) associated with color cathode ray tubes: this is an important safety factor.

Figure 6:
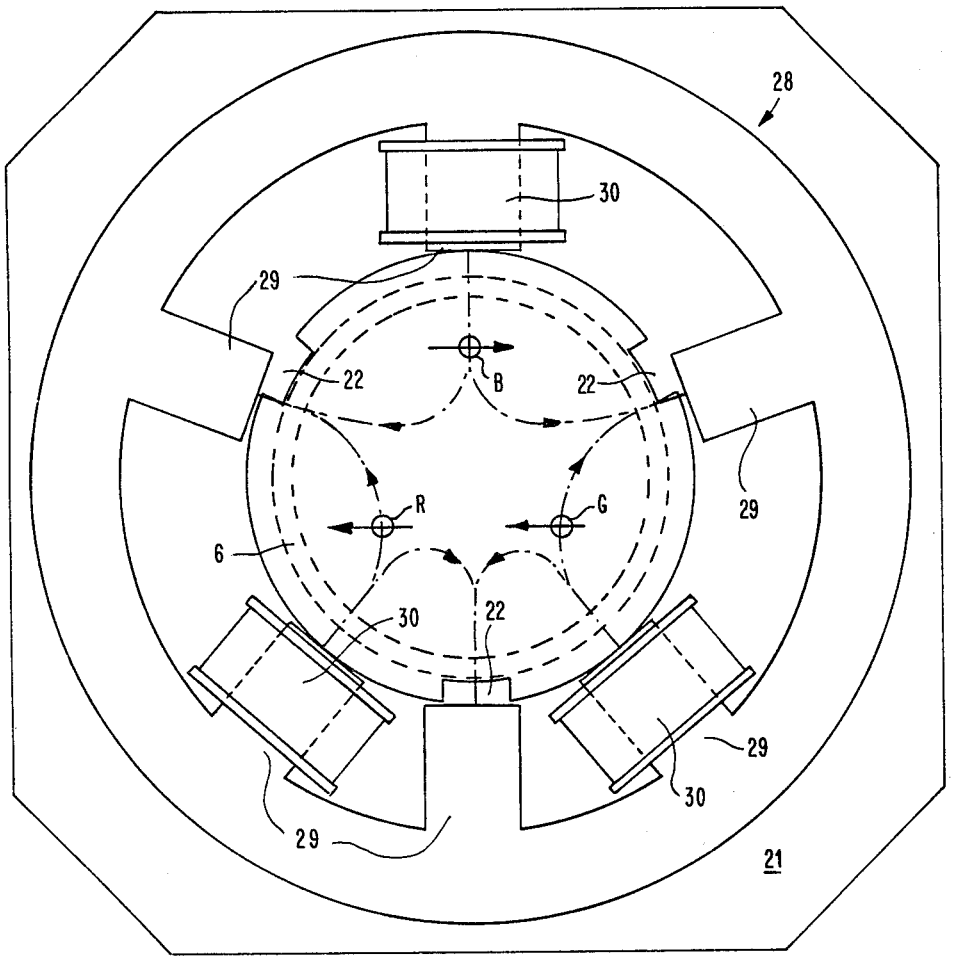
FIG. 6 shows the lateral convergence of FIG. 4 in more detail.

The lowermost inwardly-projecting polepiece 29 of the magnetic core 28 shown in FIG. 6 can be removed to leave just five inwardly-projecting polepieces without adversely affecting the operation of the lateral blue convergence assembly: this can ease the task of orienting the core during assembly thereof by making the assymetry of the core more apparent to the assembler.

Having thus described our invention, what we claim as new, and desire to secure by Letters Patent of the United States is:

1. An electromagnetic lateral convergence assembly for use in a color cathode ray tube apparatus comprising an electrically-insulating planar support adapted to be mounted on the neck of a cathode ray tube in a plane orthogonal to the neck, a first planar magnetic core of high permeability magnetic material having a generally central aperture and having integral pole pieces extending toward the center of the aperture, at least three electrical coil assemblies mounted on selected pole pieces for producing, when energized, a magnetic field within the aperture, and means securing the magnetic coil assemblies to said insulating support to hold said magnetic core in spaced parallel relationship with said support.

2. An assembly as claimed in claim 1, further comprising a second planar magnetic core of high permeability magnetic material mounted on said planar support in spaced relationship thereto on the side thereof remote from said first magnetic core, and plurality of electrical coil assemblies mounted around said second core and adapted, when energized, to produce a magnetic field whose direction and magnitude can be varied to adjust the purity.

3. An assembly as claimed in claim 1 or claim 2, wherein said planar insulating support is a printed circuit board.

4. An assembly as claimed in claim 3, wherein printed wiring connecting the coil assemblies associated with a said magnetic core is formed on the surface of said board remote from its associated magnetic core.

5. An assembly as claimed in claim 1 or claim 2, in which said insulating support has at least three inwardly projecting lugs adapted in use to center the assembly with respect to the neck of the cathode ray tube.

6. An assembly as claimed in claim 5, in which said lugs are arranged to project through slots in an electrically insulating sleeve adapted to be slidably positioned along the neck of the cathode ray tube.

7. An assembly as claimed in claim 1 or claim 2, in which at least one of said magnetic cores is formed from layers of different high permeability magnetic material thereby to improve the frequency response of the or each magnetic core.

8. An assembly as claimed in claim 1 or claim 2, enclosed by a cylindrical shield of high permeability magnetic material.

9. An assembly as claimed in claim 1 or claim 2, wherein each coil assembly associated with the first magnetic core has a first winding adapted to be energized for static lateral convergence correction and a second winding adapted to be energized for dynamic lateral convergence correction.

10. An assembly as claimed in claim 2 in which each coil assembly associated with the second magnetic core has a first winding adapted to be energized for static purity correction and a second winding adapted to be energized for dynamic purity correction.

* * * * *